US007888891B2

(12) United States Patent
Iida et al.

(10) Patent No.: US 7,888,891 B2
(45) Date of Patent: Feb. 15, 2011

(54) PARTICLE BEAM ACCELERATOR

(75) Inventors: Hidehiro Iida, Suita (JP); Toru Inomata, Suita (JP); Mamoru Fujimara, Suita (JP); Iwao Miura, Suita (JP); Toshihiro Ota, Kobe (JP)

(73) Assignee: National Cerebral and Cardiovascular Center, Osaka (JP)

( * ) Notice: Subject to any disclaimer, the term of this patent is extended or adjusted under 35 U.S.C. 154(b) by 929 days.

(21) Appl. No.: 10/594,680

(22) PCT Filed: Mar. 29, 2005

(86) PCT No.: PCT/JP2005/006579

§ 371 (c)(1),
(2), (4) Date: Apr. 19, 2007

(87) PCT Pub. No.: WO2005/094142

PCT Pub. Date: Oct. 6, 2005

(65) Prior Publication Data

US 2007/0176699 A1 Aug. 2, 2007

(30) Foreign Application Priority Data

Mar. 29, 2004 (JP) ..... 2004-095534

(51) Int. Cl.
*H05H 3/04* (2006.01)

(52) U.S. Cl. ..... 315/502; 313/62

(58) Field of Classification Search ..... 315/500–507, 315/111.21, 111.31; 313/62; 376/112
See application file for complete search history.

(56) References Cited

U.S. PATENT DOCUMENTS 2,437,915 A * 3/1948 Frondel ..... 313/62
3,348,089 A * 10/1967 Thomas ..... 313/62

(Continued)

FOREIGN PATENT DOCUMENTS

CA 2 468 777 A1 6/2003

(Continued)

OTHER PUBLICATIONS

G. Cuttone et al., "Surface Treatment of HV Electrodes for Superconducting Cyclotron Beam Extraction", IEEE Transactions on Dielectrics and Electrical Insulation, vol. 4, No. 2, Apr. 1997, pp. 218-223.

(Continued)

*Primary Examiner*—Jacob Y Choi
*Assistant Examiner*—Ephrem Alemu
(74) *Attorney, Agent, or Firm*—Birch, Stewart, Kolasch & Birch, LLP

(57) ABSTRACT

A particle beam generator has a vacuum chamber, a magnet which generates a constant magnetic field in the vacuum chamber, acceleration electrodes which generates a magnetic field in a direction perpendicular to the direction of the magnetic field generated by the magnet in the vacuum chamber, a take-out electrode which takes out charged particles accelerated in the vacuum chamber; and a target cell provided at a position at which the charged particles taken out by the taken-out electrode strikes. At least a part of surfaces exposed to the charged particles of the vacuum chamber, the acceleration electrodes, the take-out electrode and/or the target cell is made of a material including an element having atomic number larger than copper.

15 Claims, 8 Drawing Sheets

U.S. PATENT DOCUMENTS

| | | | | |
|---|---|---|---|---|
| 3,725,709 | A | 4/1973 | Hendry et al. | |
| 3,921,019 | A | 11/1975 | Karasawa et al. | |
| 3,925,676 | A * | 12/1975 | Bigham et al. | 376/112 |
| 4,055,782 | A * | 10/1977 | Hudson et al. | 315/111.91 |
| 4,112,306 | A * | 9/1978 | Nunan | 376/112 |
| 4,812,775 | A | 3/1989 | Klinkowstein et al. | |
| 5,372,862 | A | 12/1994 | Krishnaswamy | |
| 5,752,645 | A | 5/1998 | Phillips et al. | |
| 5,874,811 | A | 2/1999 | Finlan et al. | |
| 6,441,569 | B1 * | 8/2002 | Janzow | 315/502 |
| 6,468,043 | B1 | 10/2002 | Benvenuti | |

FOREIGN PATENT DOCUMENTS

| | | | |
|---|---|---|---|
| EP | 0 426 277 | A2 | 5/1991 |
| JP | 58-179800 | A | 12/1983 |
| JP | 61-193700 | A | 2/1986 |
| JP | 64-035898 | U | 2/1989 |
| JP | 7-159543 | A | 6/1995 |

OTHER PUBLICATIONS

S. Brandenburg et al., "The RF- System of the Agor -Cyclotron", Proceedings of the Fifteenth International Conference on Cyclotrons and their Applications, Caen, France, Jun. 14-19, 1998, pp. 171-174.

* cited by examiner

PARTICLE BEAM ACCELERATOR

TECHNICAL FIELD

The invention relates to a particle beam accelerator such as a cyclotron.

BACKGROUND ART

A particle beam accelerator accelerates electrically charged particles in vacuum. A cyclotron, one of the particle beam accelerators, accelerates them in a constant magnetic field with an alternating high frequency electric field generated between a pair of electrodes. Charged particles introduced from an ion source are accelerated to move along a spiral orbit with the period of the high frequency electric field. A particle beam moving along a circular orbit at the maximum radius is extracted towards the external to strike a target.

Particle beam accelerators such as cyclotrons are used in various fields. Compact cyclotrons are used in hospitals or the like in order to generate radioisotopes used for examination. For example, $^{15}O$ nuclei are produced by irradiating $^{14}N_2$ gas with a deuteron beam generated by a particle beam accelerator, and a drug is synthesized by a chemical reaction by using the radioisotopes. In such a system, a drug such as $C^{15}O$ gas is generated. As another example, a substance for cancer diagnosis is synthesized by using $^{18}F$ generated with $^{18}O(p, n)^{18}F$ reaction.

As to a cyclotron, there is the principle that a momentum of an accelerated particle is proportional to a product of radius of curvature of the accelerated orbit and magnetic flux density. Therefore, if the magnetic flux density is constant, the size of a cyclotron becomes larger as the energy of the beam to be extracted becomes higher.

When the beam strikes a target thick enough to be stopped within the target, the number of isotopes generated by the nuclear reaction per unit current becomes larger as the energy of the beam becomes larger. Therefore, a deuteron beam is accelerated up to a relatively high energy of about 10 MeV in many cyclotrons used for drug synthesis.

On the other hand, for example, in a reaction for generating $^{15}O$ from $^{14}N$, a sufficient amount of the drug can be synthesized with a deuteron beam of acceleration energy of about 3.5 MeV. For example, when the acceleration energy is 3.5 MeV, $^{15}O$ label can be produced with a deuteron beam of about 500 mCi. Then, cyclotrons of a relatively small size are developed (for example, refer to Oxygen Generator System Product Description (Ion Beam Accelerations)).

Radioactive rays are generated when an energy beam from the particle beam accelerator injected directly or after scattering onto a substance. Generally, the accelerated particles strike not only the target, but also electrodes, inner walls, residual gas and a target cell in the accelerator. If particles scattered after striking the electrodes or the like have a sufficiently high energy, they may strike another component to generate radioactive rays. For example, in the above-mentioned reaction to radiate a deuteron beam onto $^{14}N$ nuclei to generate $^{15}O$ nuclei, neutrons and gamma rays may be generated. Further, other reaction processes also occur, so that various types of radioactive rays are generated in the accelerators.

Because radioactive rays affect a human body, it is important to decrease the amount of the generated radioactive rays. Therefore, a particle beam accelerator has various shields. Especially, neutrons and gamma rays are difficult to be shielded because they have high transparency against a substance, in contrast to charged particles. Then, an accelerator is set in a room having walls and a floor made of thick concrete.

However, a particle beam accelerator occupies a large volume and has a high weight, so that it is necessary to take the strength of the setting area into account sufficiently. Therefore, it is desirable to decrease the volume occupied by the accelerator and to reduce the weight thereof. In order to solve the problem, a self-shield is developed to cover a cyclotron as one of the accelerators with a shield for the main body of the accelerator and for radioactive rays generated at the target. For example, a concrete wall as thick as one meter is used as a self-shielding wall. Though a cyclotron of Ion Beam Accelerations is compact, the outer size of the concrete used for shielding the cyclotron is about 4*2.8*3.4 m in an open state. Thus, it is difficult to install such a cyclotron newly in an existing building. Therefore, it is desirable to provide a particle beam accelerator reduced further in size and weight.

DISCLOSURE OF INVENTION

An object of the invention is to provide a particle beam accelerator reduced in size and weight further.

A particle beam generator according to the invention has a vacuum chamber, a magnet which generates a constant magnetic field in the vacuum chamber, acceleration electrodes which generates a magnetic field in a direction perpendicular to the direction of the magnetic field generated by the magnet in the vacuum chamber, a take-out electrode which takes out charged particles accelerated in the vacuum chamber; and a target cell provided at a position at which the charged particles taken out by the taken-out electrode strikes. At least a part of surfaces exposed to the charged particles of the vacuum chamber, the acceleration electrodes, the take-out electrode and/or the target cell is made of a material including an element such as gold, tantalum or tungsten having atomic number larger than copper. The material may be an alloy or a compound. The material may be used in various ways. For example, it may have a form of a sheet, plate or the like, or a plating layer.

For example, at least a part of the surfaces exposed to the charged particles of the vacuum chamber, the acceleration electrodes, the extraction electrode and/or the target cell is covered by a sheet of the material including an element having atomic number larger than copper.

Preferably, the target cell is separated from the other components in the particle beam accelerator, and a shielding wall for shielding radioactive rays generated in the target cell is provided around the target cell.

Preferably, the particle beam accelerator is integrated as a unit with a synthesis apparatus which receives a substance generated in the target cell as a starting material.

It is an advantage of the invention that the particle beam accelerator is reduced further in size and weight while reducing radioactive rays efficiently for irradiation of a low energy beam. Thus, such a cyclotron can be set in an existing building.

BEST MODE FOR CARRYING OUT THE INVENTION

Figure 1:
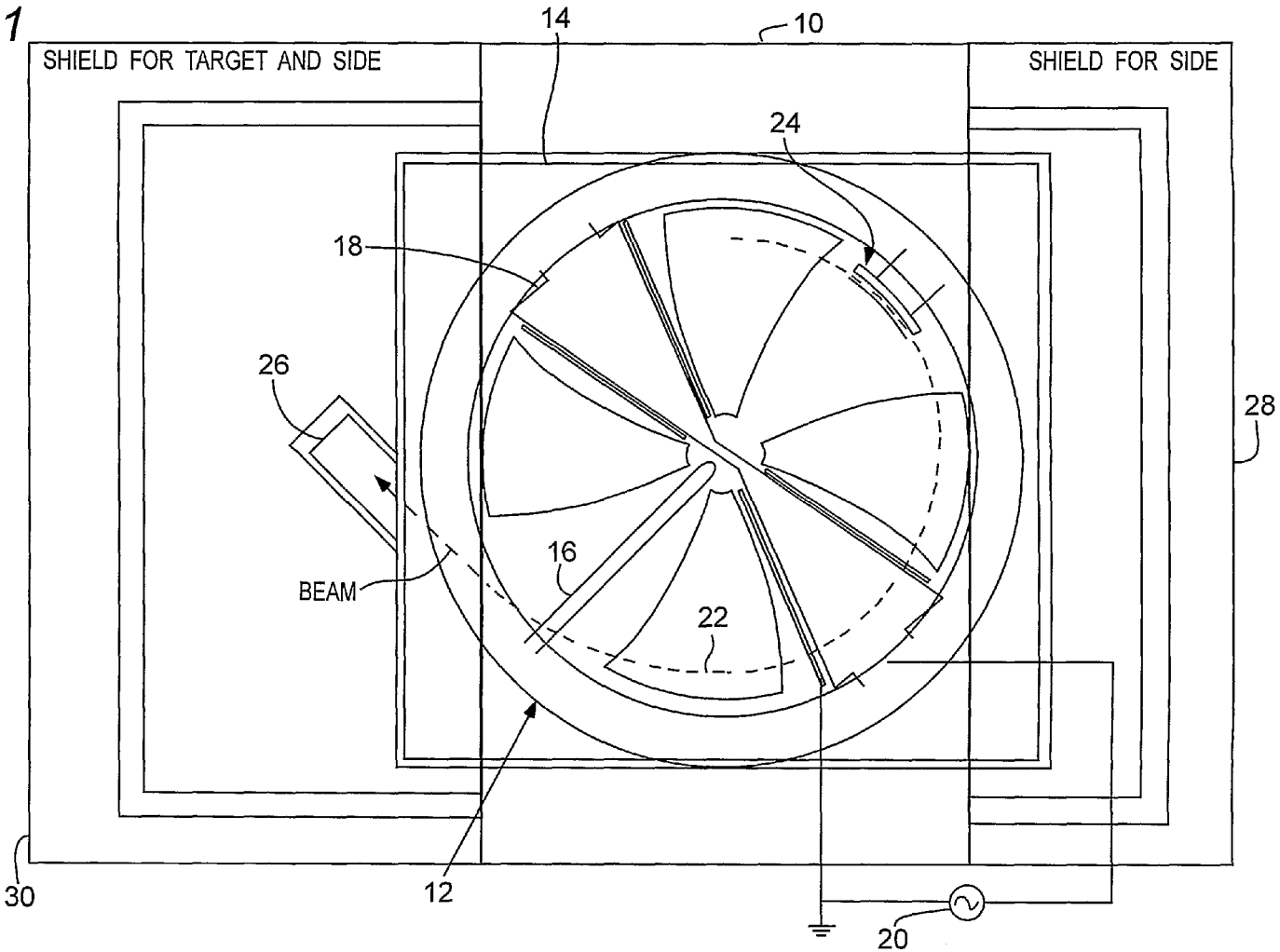
FIG. 1 is a schematic plan view of a cyclotron.

Referring now to the drawings, wherein like reference characters designate like or corresponding parts throughout the several views, embodiments of the invention are explained below.

Figure 2:
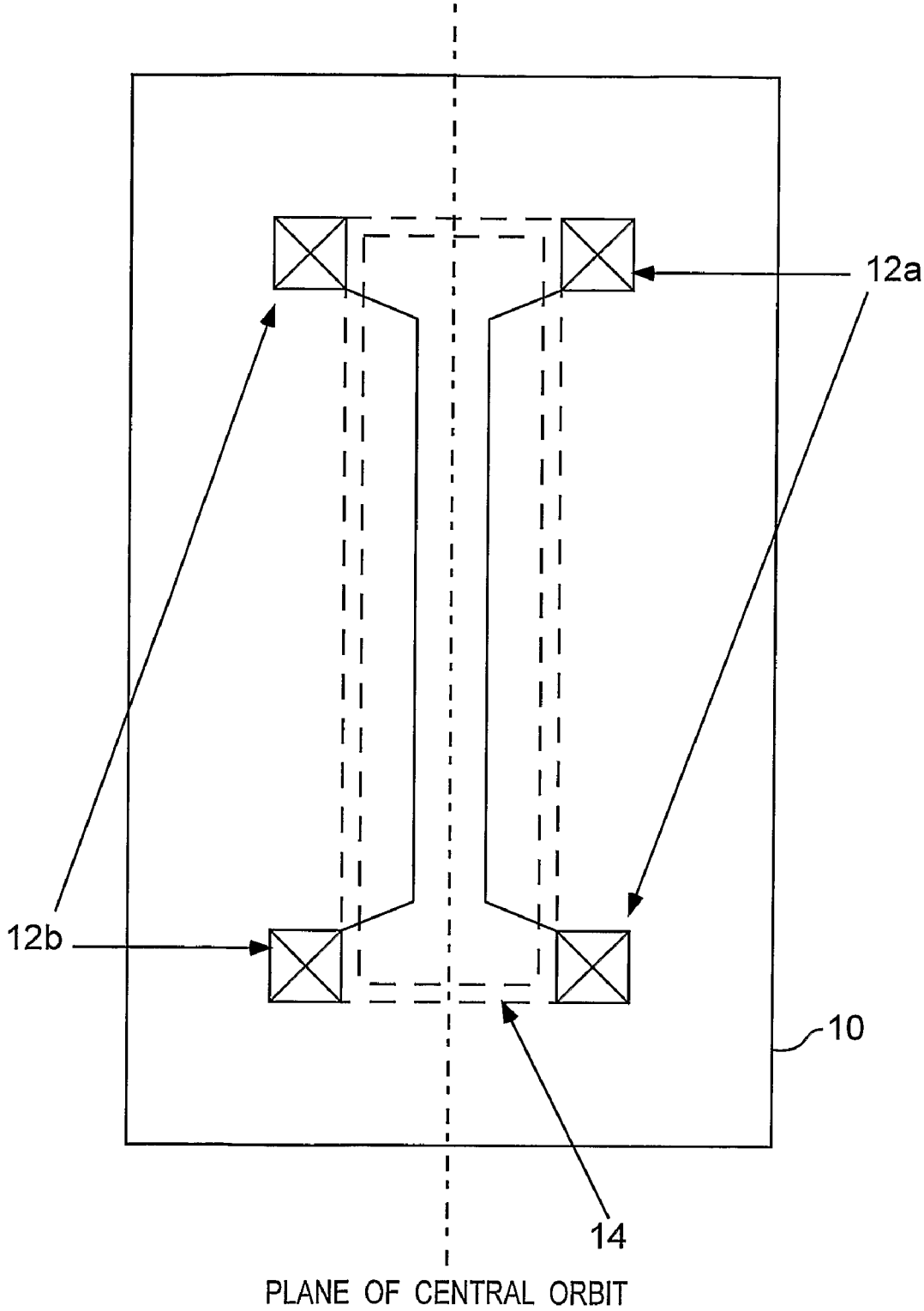
FIG. 2 is a schematic side view of the cyclotron.

FIG. 1 and FIG. 2 show a general plan view and a general side view of a cyclotron, respectively. The cyclotron has a main electromagnet 10 made of an electromagnetic soft iron for generating a constant magnetic field, main coils 12 (12*a* and 12*b*) and a vacuum chamber (acceleration box) 14 between them as a cavity kept in vacuum. The main electromagnet 10 consists of four sector magnets. Charged particles such as deuterons or protons are supplied from an ion source 16 to a center of the vacuum chamber 14. The ion source 16 is a cold cathode Penning or Phillips Ionization Gauge (PIG) ion source in this embodiment. A pair of D electrodes 18 is provided in the vacuum chamber 14, and a high frequency alternating electric field generated by a high frequency power supply 20 is applied in a gap between them. The rounding movement of charged particles is accelerated in the high frequency electric field. A deflector 24 or a device for deflecting the circulating ions 22 outwardly in an external direction is provided outside an orbit of the maximum circular movement, and the radius of the orbit is called as extraction radius. Then, a target cell (target case) 26 is provided at a location where the charged particles deflected by the electrode in the deflector 24 strike the target cell. Further, shields 28 and 30 are provided at sides of the main body of the cyclotron.

Figure 3:
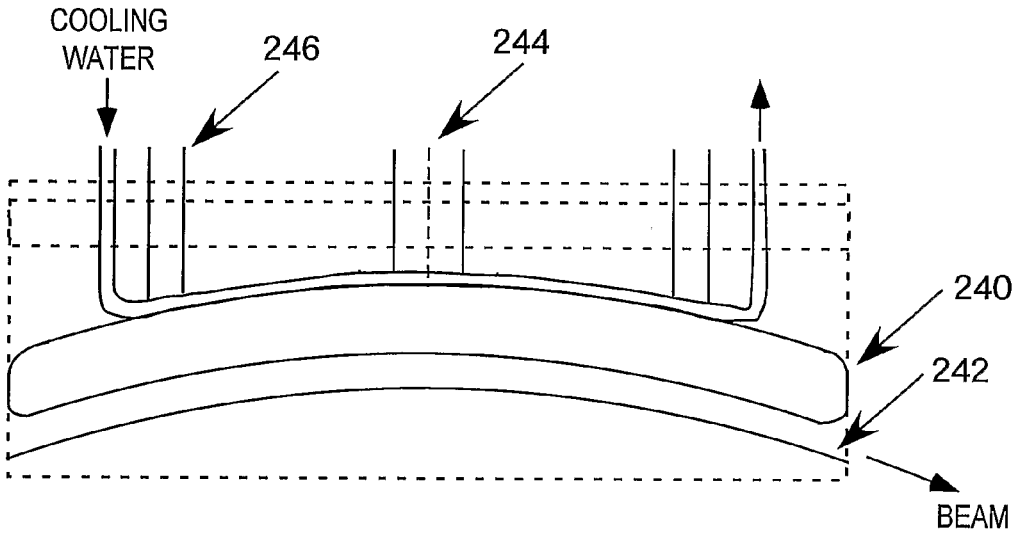
FIG. 3 is a front view of a deflector.
Figure 4:
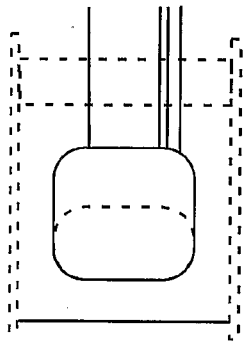
FIG. 4 is a side view of the deflector.

FIG. 3 and FIG. 4 show a front view (in a beam orbit plane) and a side view of the deflector 24, respectively. The deflector 24 consists of a deflector electrode 240 arranged along a circular orbit, a separator 242 opposing an inner plane of the deflector electrode 240, a high voltage electrode 244 for supplying a high voltage to the deflector electrode 240 and a support bar 246 for supporting the deflector electrode 240.

Figure 5:
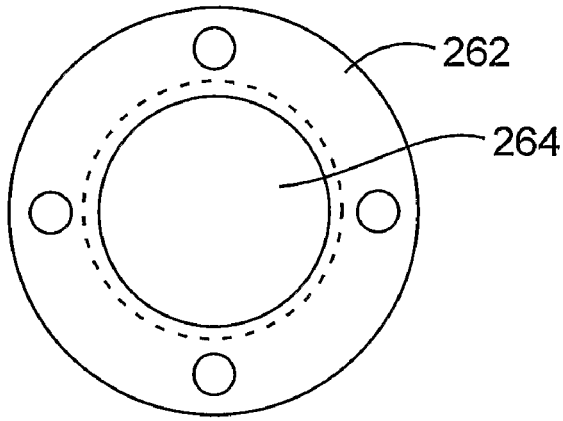
FIG. 5 is a front view of a target cell.
Figure 6:
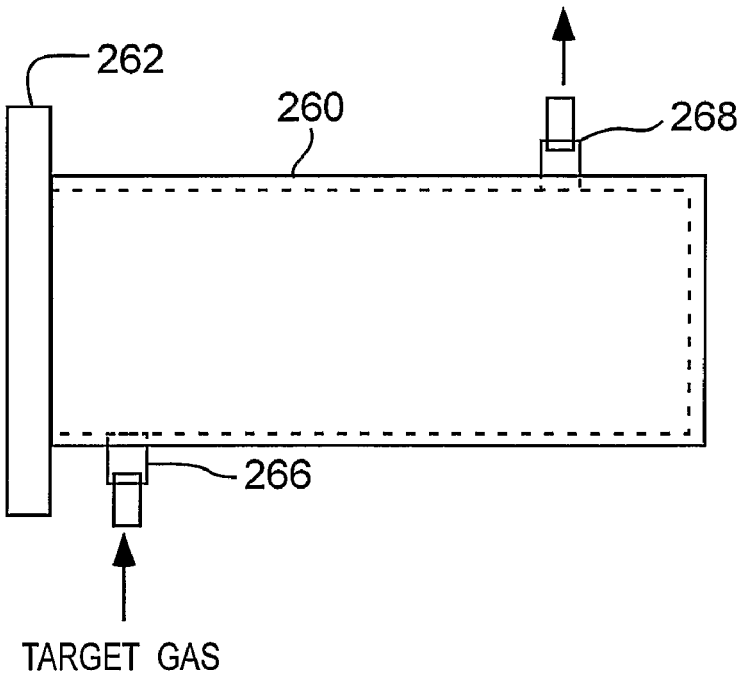
FIG. 6 is a side view of the target cell.

FIG. 5 and FIG. 6 show a front view and a side view of a target cell 26, respectively. The target cell 26 consists of a cylindrical main body 260 for containing a target gas, a flange 262 at the front side and a target window 264. The main body 260 of the target cell 26 has an inlet 266 and an outlet 268 for introducing and discharging a target gas. For example, when $^{15}O$ gas is prepared, a nitrogen gas including 0.5 to 2.5% oxygen gas is introduced into the target cell 26. Then, the gas is irradiated with deuterons to generate $^{15}O$ gas based on the nuclear reaction of $^{14}N(d, n)^{15}O$.

In order to decrease the size of a cyclotron, it is proposed to decrease the acceleration energy to an order at which a certain amount of radioisotopes can be produced in the target cell 26. Even if the acceleration energy is decreased, it is further necessary to decrease the weight of the shielding structure for shielding radioactive rays generated secondarily by the charged particles. In order to reduce the weight, the inventors propose that the components with which the beam is liable to collide are made of materials difficult to generate radioactive rays. Then, various materials are measured on the beam energy dependence of the shielding performance thereof.

Generally the acceleration energy used in a small cyclotron is 10 or 18 MeV. However, in this measurement, various materials are irradiated with deuterons of 10 MeV and of 3.5 MeV to measure dose equivalent of neutrons generated. The materials of the target range from $_{12}C$, $_{13}Al$, $_{22}Ti$, $_{26}Fe$ and $_{29}Cu$ of relatively small atomic numbers to $_{41}Nb$, $_{42}Mo$, $_{64}Gd$, $_{73}Ta$, $_{74}W$ and $_{82}Pb$ of relatively large atomic numbers. The beam is stopped at the target, and the resulting current is measured. As to the deuteron beam of 3.5 MeV, the angular dependence of dose equivalent is measured at 0, 45, 90 and 135 degrees, while as to the deuteron beam of 10 MeV, the angular dependence is measured at 0, 90 and 135 degrees. A neutron survey meter and an organic liquid scintillator are used for the radiation detector.

Figure 7:
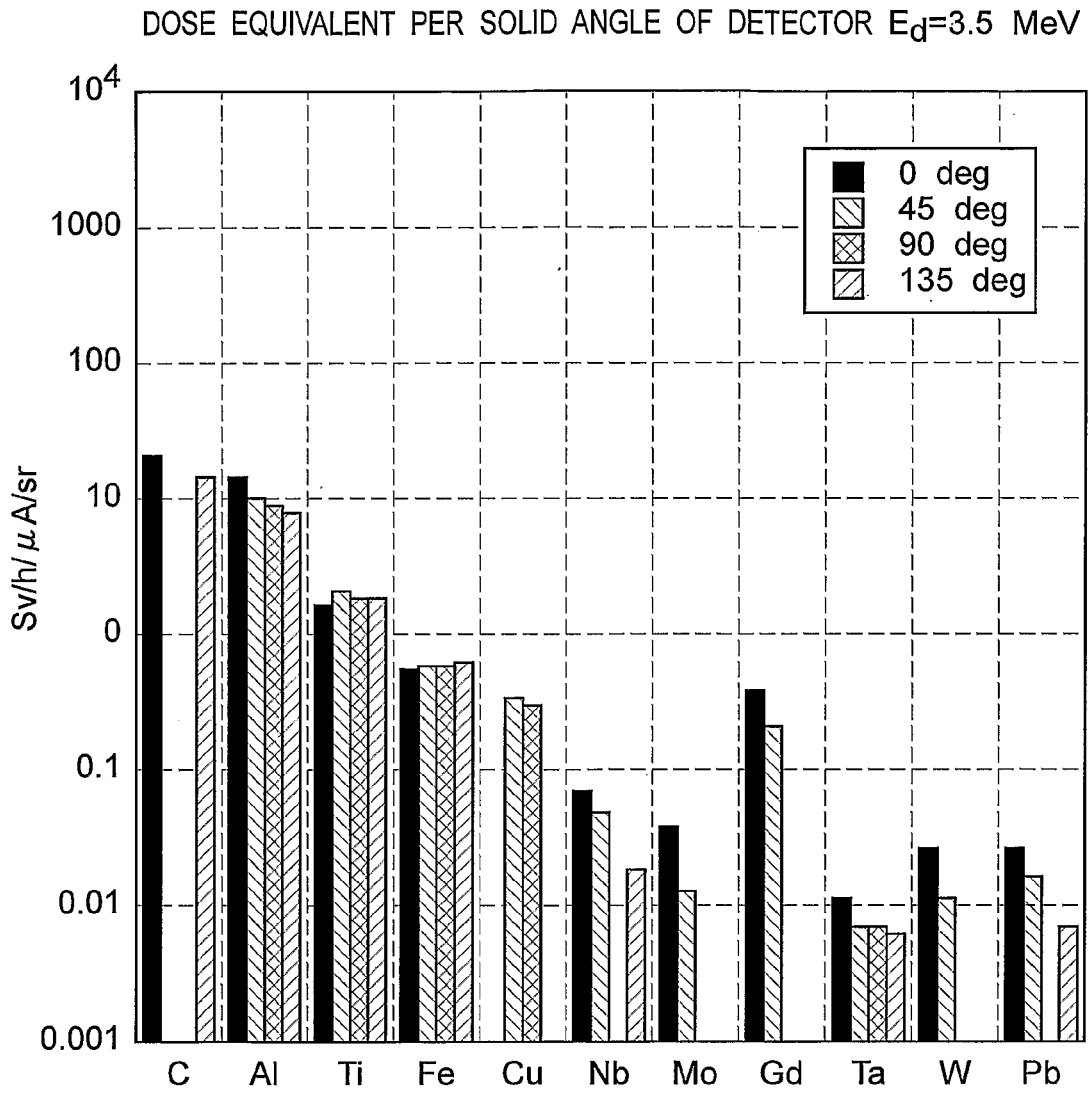
FIG. 7 is a graph of measurement data when a deuteron beam of 3.5 MeV is used.
Figure 8:
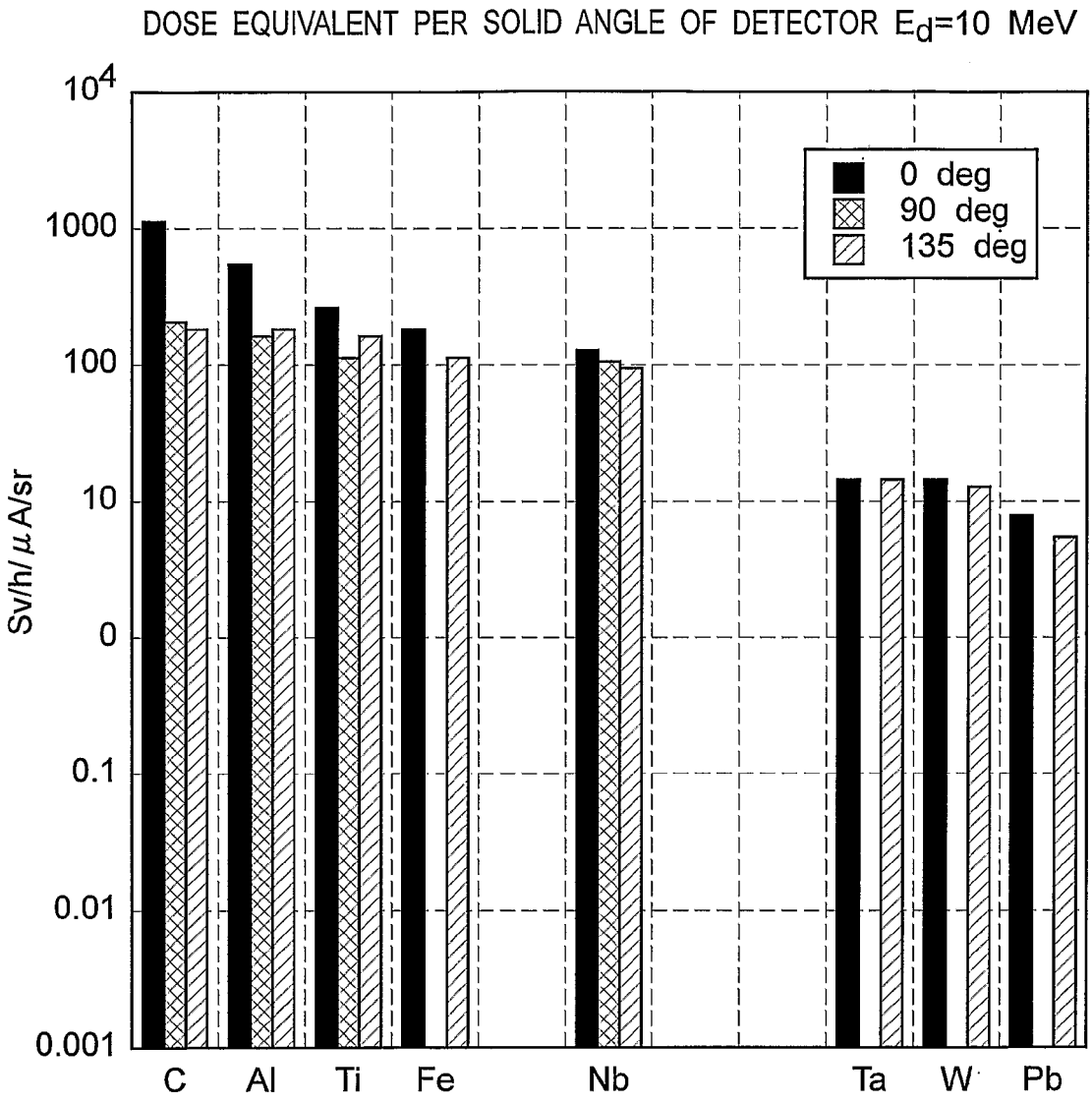
FIG. 8 is a graph of measurement data when a deuteron beam of 10 MeV is used.

FIG. 7 and FIG. 8 show measurement data for irradiation with a deuteron beam of acceleration energy of 3.5 MeV and of 10 MeV, respectively. The angular dependence of the data is small for the two energies. According to the data shown in FIG. 8 on irradiation with the deuteron beam of acceleration energy of 10 MeV, the dose equivalent of neutrons per unit current generated deceases with increasing atomic number (Z). However, as shown in FIG. 7 on the data on irradiation when the deuteron beam of acceleration energy of 3.5 MeV, the dose equivalent of neutrons per unit current generated is smaller on the same atomic nuclei, and the degree of the decrease thereof with increasing atomic number is smaller, when compared with the data shown in FIG. 8. In the case of aluminum nuclei, the dose equivalent of neutrons generated by the beam of 3.5 MeV is smaller than 1/10 of the counterpart generated by the beam of 10 MeV. As the atomic number increases, the dose equivalent decreases largely to less than 1/10 for copper, and less than 1/100 for tantalum and tungsten. On the other hand, in the case of 10 MeV beam, the degree of the decrease in dose equivalent for tantalum and tungsten relative to that for aluminum is as small as about a few tenths.

The data for 3.5 MeV beam compiled in FIG. 7 shows that the generation of neutrons can be suppressed to a large extent if materials such as niobium, molybdenum or tantalum having atomic numbers larger than copper are used. For example, for a material having an atomic number larger than copper, the dose equivalent of neutrons can be decreased less than a hundredth if compared with the data for the beam of 10 MeV. Generally, it is thought that because the weight of a nucleus increases with increasing atomic number, the nucleus becomes harder to react with the incident beam or becomes difficult to generate radioactive rays. However, it is found that gadolinium is an exception wherein the dose equivalent of neutrons for 3.5 MeV beam is a little larger than one hundredth of that for 10 MeV. However, even in this case, the dose equivalent of neutrons for 3.5 MeV beam becomes much smaller than that for 10 MeV.

Then, in the above-mentioned cyclotron for generating a deuteron beam of low energy, materials having larger atomic numbers are used for components to which the low energy beam or the scattered particles strike, in order to prevent generation of radioactive rays such as neutrons. In concrete, materials having atomic numbers larger than copper are used as the materials for preventing generation of radioactive rays (hereinafter referred to as preventive materials). For example, the preventive material may be a nonmagnetic alloy or compound of an element having the atomic number larger than copper. Preferably, a material having larger atomic numbers equal to or larger than 73 such as tantalum or tungsten is used.

When the preventive materials for suppressing generation of radioactive rays are represented with the dose equivalent of neutron, they include elements having dose equivalent equal to or smaller than about 0.2 mSv/h/μA/(solid angle of detector). More preferably, materials having dose equivalent equal to or smaller than about 0.02 mSv/h/μA/(solid angle of detector) are used.

When the preventive materials for suppressing generation of radioactive rays are defined with the entire solid angle, the solid angle of the detector is $7.98*10^{-4}$ sr in the measurement because the sensitive component of the detector is cylindrical with diameter 25.8 mmΦ and height 70 mm and has a length 80 mm from the target to the sensitive component. Thus, the above-mentioned 0.2 mSv/h/μA/(solid angle of detector) corresponds to $0.2/(7.98*10^{-4})$ mSv/h/μA/sr=$2.5*10^{-1}$ Sv/h/μA/sr, and the 0.02 mSv/h/μA/(solid angle of detector) corresponds to $2.5*10^{-2}$ Sv/h/μA/sr. Therefore, the preventive materials are preferably materials having the dose equivalent for neutrons equal to or smaller than about $2.5*10^{-1}$ Sv/h/μA/sr, and more preferably, they are materials having the dose equivalent for neutrons equal to or smaller than about $2.5*10^{-2}$ Sv/h/μA/sr.

It is to be noted that the energy of neutrons generated at the target cell also depends on the target material. The amount of the shield therefore would be smaller when neutron energy is smaller. Therefore, among preventive materials having about the same order of performance for preventing generation of radioactive rays, a material generating neutrons having smaller energy is used preferably. For example, when a deuteron beam of 3.5 MeV is used, the maximum neutron energy generated at $^{181}$Ta is 8.0 MeV, and that generated at $^{208}$Pb is 5.1 MeV. Therefore, a lead sheet or the like is useful from the view point for shielding neutrons.

Table 1 shows basic numerical values on the structure of the cyclotron reduced in size. The cyclotron is used exclusively for a lower energy beam than previously, and the energy of the charged beam is set about 3 MeV. The high frequency of the electric field is set to 60 kHz. By accelerating deuterons having energy as low as 4 MeV, $^{15}$O or the like can be generated. The magnetic field generated by the main magnet is about 2 Tesla, and the radius of the D electrode 18 (or extraction radius) is set to about 30 cm. The diameter of the cyclotron becomes smaller for a previous cyclotron using 9 MeV beam. Because preventive materials are used, the amount of the shielding material can be decreased, or the shielding can be reduced in size and weight.

TABLE 1

Basic numerical values for the cyclotron

| | Sign | Expression | Value |
|---|---|---|---|
| Magnetic field scheme | | Setting according to design | AVF |
| Number of sectors | | Setting according to design | 4 |
| Average mag field | B | ρ ≈ 1.44 q/B/sqrt(AE), q = 1, A = 2, E = 3. | 1.9T |
| Extraction radius | ρ | 5 | 29 cm |
| Pole radius | R | R = ρ/0.9 | 32 cm |
| Angular velocity | ω | ω = qB/m | 60 MHz |
| Hill gap | Gh | Setting according to design | 34 mm |
| Valley gap | Gv | Setting according to design | 50 mm |
| Hill angle | Ah | Setting according to design | 32° |
| Valley angle | Av | Setting according to design | 58° |
| Average gap | <G> | <G> = GvGh(Av + Ah)/(GhAv + GvAh) | 43 mm |
| Hill mag field | Bh | Bh = B(<G>/Gh) | 2.4 T |
| Valley mag field | Bv | Bv = B(<G>/Gv) | 1.6 T |

TABLE 1-continued

Basic numerical values for the cyclotron

| | Sign | Expression | Value |
|---|---|---|---|
| Magnetomotive force | NI | NI = B<G>/4π * $10^{-7}$ | 6.5E+04 A · turn |
| weight of iron | W | W□B*R | 6 ton |

Table 2 shows examples of materials used for various components in the cyclotron. In this example, the film for the deflector 24 and the like are made of materials such as tungsten (W), tantalum (Ta) and molybdenum (Mo) having large atomic numbers.

TABLE 2

Main materials for the cyclotron

| Component | Material |
|---|---|
| Magnetic poles | Iron (electromagnetic soft iron), Copper |
| Coils | Copper (oxygen-free copper) |
| Electrodes for acceleration | Gold |
| Deflector | Copper, Tungsten |
| Acceleration chamber | Aluminum |
| Current probe | Copper or the like |
| Ion source | Copper, Tantalum or Molybdenum |
| Target film | Titanium |
| Target | Nitrogen |
| Target cell | Aluminum |

In order to suppress generation of radioactive rays further, a structural element such as a metallic pillar having a surface made of the preventive materials is added preferably at an appropriate position to block a part of the beam circulating an unnecessary orbit around the valley. The structural element may be put in an area not including the electrodes for the resonator (as a dummy D) or in the valley of the poles of the electromagnet. Alternatively, a heater is provided preferably at one of the components (including the dummy D and the like if any) arranged in the vacuum chamber 14. The heater can heat the component sufficient to release deuterons absorbed in the component. By heating the component with the heater, the deuterons in the component are released so that a reaction thereof with the deuteron beam or a (d, d, n) nuclear reaction is suppressed. Alternatively, in order to make the beam difficult to strike components arranged in the cyclotron, the gap in the cyclotron is widened than in a conventional cyclotron.

In order to suppress the generation of radioactive rays, a sheet (or plate) of a preventive material is fabricated, and components exposed to the low energy beam of charged particles or the scattered particles in the cyclotron are made from the sheet (plate). For example, the separator component 242 of the deflector 24 and the like exposed to the low energy beam of charged particles or the scattered particles are made of a thin plate of tantalum or tungsten. The thickness of the preventive material for the components is selected to have a value within which the beam of accelerated charged particles is stopped. For example, the deuteron beam of 3.5 MeV is stopped at about 0.03 mm thickness. Therefore, the thickness of the sheet (or plate) of the preventive material is selected to become larger than 0.03 mm and smaller than, for example, 1 mm.

The sheet of the preventive material may be arranged on all the inner planes subjected the low energy beam and the scattered particles. Practically, a thick electromagnetic soft iron is arranged at portions except the sides of the cyclotron, and the electrodes near the beam are conventionally covered with copper. Though a part of the beam striking the copper may transmit the copper to reach to the electromagnetic soft iron, leakage of radioactive materials from the electromagnetic soft iron is small because the electromagnetic soft iron is thick and the beam energy is small. On the other hand, it is disadvantageous to arrange many sheets of preventive materials such as tantalum near the magnetic poles because disturbance of the high field electric field may occur. Therefore, it is not needed to arrange the preventive materials on all the inner planes of the cyclotron. The amount of generated radioactive rays can be suppressed even when the preventive material is arranged only in a necessary part of the surfaces exposed to the charged particles in the degree not to disturb the high frequency electric field. Main sources of radioactive rays in a particle beam accelerator for generating a low energy beam such as a compact cyclotron are the target in the target cell 26, the target window 264, the deflector 24, the D electrodes 18 around the gap and the vacuum chamber 14. Then, preferably surfaces thereof in the cyclotron exposed to a charged particle beam or scattered particles are made of sheets of the preventive materials.

Practically, sheets of a preventive material are adhered to regions at which the particle beam or scattered particles strike. That is, a sheet of a preventive material is adhered to the surface of a component in the cyclotron such as the deflector 24 to take out the particle beam, the D electrodes 18, the vacuum chamber 14 or the like having structures similar to a prior art structures. Gold is preferable as the preventive material for the sheet. The sheet may cover not only a portion of for example the deflector 24 facing the approaching charged particles, but it may cover the entire surfaces of the components in the vacuum chamber arranged near the circulating orbit of the beam and facing the charged particles.

Alternatively, the surface of the above-mentioned components in vacuum chamber 14 may be plated with a plating solution including the preventive material to form a plating layer, instead of the sheet of the preventive material. That is, the surface of the above-mentioned components may have a plating layer including the preventive material. Alternatively, it may be coated with a coating material including the preventive material to form a coating film. That is, the surface of the above-mentioned components may have a coating film including the preventive material. The plating layer or the coating film is has a thickness selected to have a value within which the beam of accelerated charged particles is stopped. Tantalum, gold or the like may be used as the preventive material as mentioned above, but gold is preferable for a plating solution.

The electrodes in the accelerator are conventionally made of copper. It is preferable to use gold for the electrodes as the preventive material. For example, gold is plated on the main bodies of the electrodes, or gold foils or sheets are adhered to the main bodies of the electrodes.

As to the target cell 26, the inside thereof other than the target window 264, especially portions adjacent to the target window, may be covered preferably by the above-mentioned sheet, painting layer or coating film. For example, tantalum or tungsten is used for the portions adjacent to the target window. Further, a current probe, provided in the vacuum chamber 14, for measuring the current of the accelerated beam may have a surface (usually made of copper) covered by the above-mentioned sheet, painting layer or coating film having the preventive material. Thus, generation of neutrons is suppressed at the measuring instrument.

In a target such as nitrogen gas, it is expected that a large amount of radioactive rays such as neutrons is generated, and shielding of neutrons, gamma rays and the like becomes necessary. However, in the case of a self-shielding cyclotron, if the target is located near the main body of the cyclotron, the shield overlaps the main body so that the size of the cyclotron becomes large. On the other hand, in a compact cyclotron, the target cell 26 is positioned independently of and distantly from the main body of the cyclotron, and a shielding wall is provided around the target cell 26 to shield the generated neutrons and the like. Further, the main body of the cyclotron is surrounded by a shielding material such as iron or paraffin mixed with lead. Because the preventive materials are used in the cyclotron, even if radioactive rays are generated, the amount of the generated radioactive rays is low. Then, the amount of the shield can be decreased to a large extent.

The above-mentioned compact cyclotron can be integrated as a unit with a synthesis apparatus which uses the substance generated in the target cell in the cyclotron as a starting material for the synthesis. In a diagnosis system for an image of brain blood stream oxygen metabolism which uses $^{15}O$ positron emission tomography (PET), a radioactive drug such as $C^{15}O$ or $C^{15}O_2$ is prepared by the synthesis apparatus by using $^{15}O$ generated by the cyclotron, and the brain blood stream oxygen metabolism is diagnosed with the radioactive drug used as a tracer by the PET apparatus. As to the synthesis of a radioactive drug, a compact synthesis apparatus is developed recently wherein $C^{15}O$ and $C^{15}O_2$ are prepared at room temperature by using $^{15}O$ (refer to Japanese Patent laid open Publication 2003-167096, FIG. 1), and the disclosure is incorporated by reference to the description. In the synthesis apparatus, target gas or nitrogen gas including carbon monoxide (carrier gas) is supplied into the target cell 26, and the gas in the target cell is irradiated by a deuteron beam to synthesize $C^{15}O$. Further, a part of the synthesized $C^{15}O$ is allowed to contact with oxidation catalyst (manganese dioxide-copper oxide (II)) in the presence of dry oxygen at room temperature. Thus, by supplying $^{15}O$ from the target cell 26 in the cyclotron, all three types of tracer gases ($^{15}O$, $C^{15}O$ and $C^{15}O_2$) necessary for the examination of brain blood stream oxygen metabolism are prepared and supplied readily by using positron emission tomography.

Figure 9:
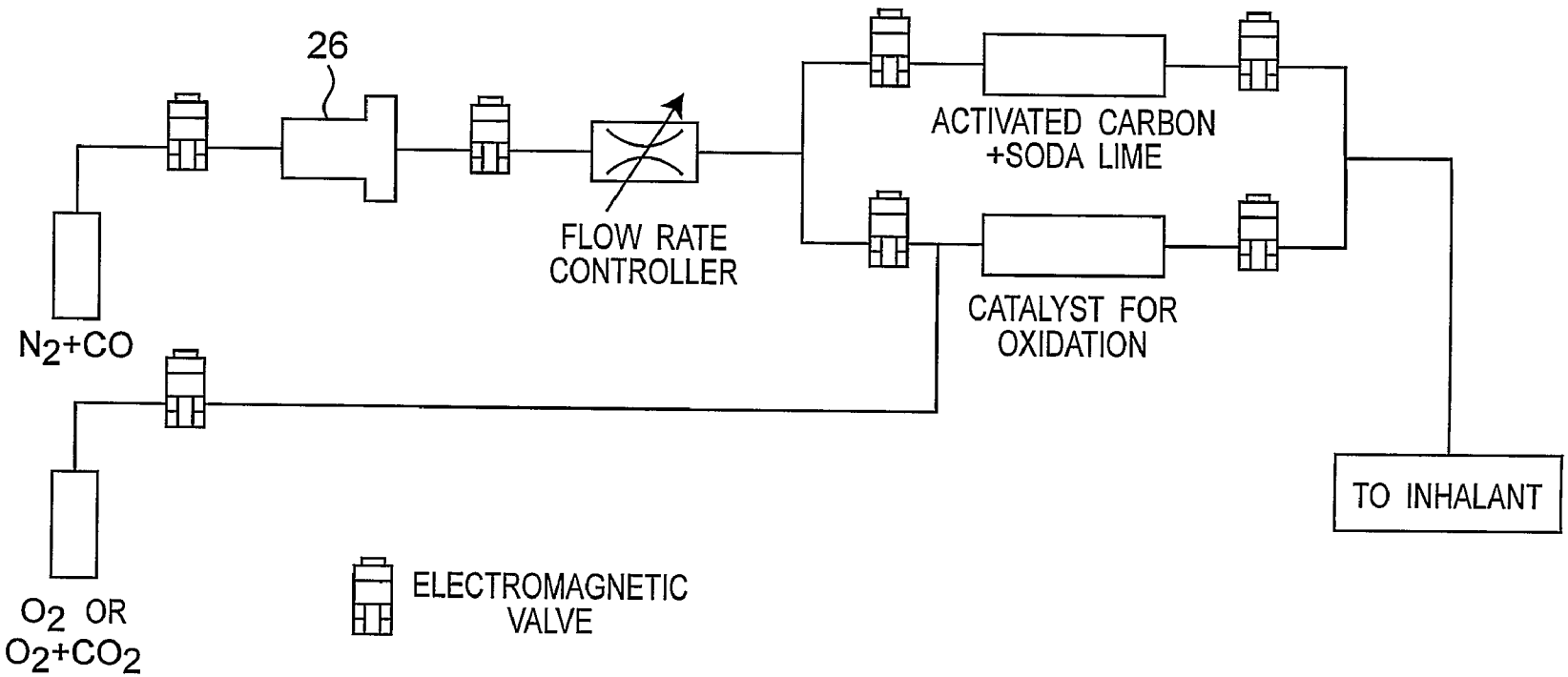
FIG. 9 is a diagram of gas flow paths in a system of a cyclotron integrated with a synthesis apparatus.
Figure 10:
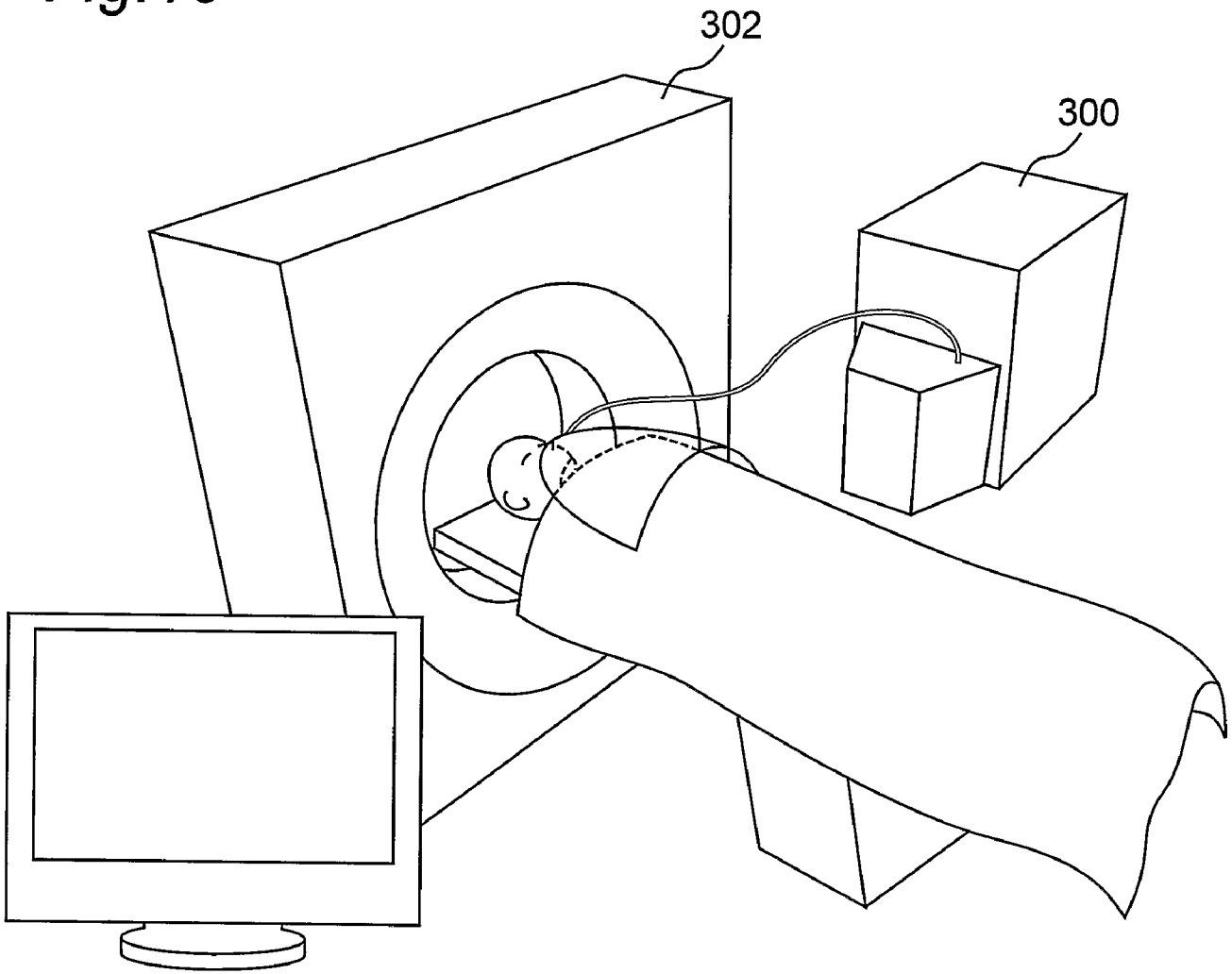
FIG. 10 is a diagram of an image diagnosis system provided in a room, including an integrated apparatus of the cyclotron and the synthesis and a positron emission tomography examination apparatus.

FIG. 9 shows a diagram of gas flow path in the integrated system including the compact cyclotron and the synthesis apparatus. In concrete, a target gas is supplied to an inlet 266 of the target cell 26 in the cyclotron, and $^{15}O$ and $C^{15}O$ generated are taken out from an outlet 268 of the target cell 26. The $C^{15}O$ taken out is branched in two ways. A part of the $C^{15}O$ is mixed with dry oxygen or with a mixture gas of dry oxygen and dry carbon dioxide, and the resultant mixture gas is led to the oxidation catalyst to produce $C^{15}O_2$. The obtained tracer gases are fed to an inhalant of the PET examination apparatus. The above-mentioned synthesis of the radioactive drugs can be automated by providing a flow rate controller and electromagnetic valves in gas paths as shown in FIG. 9. By using the integrated system, the size of the entire image diagnosis system including the integrated apparatus having the cyclotron and the synthesis apparatus and the PET examination apparatus 302 can be reduced further, and as shown schematically in FIG. 10, the entire system can be arranged in a room.

The above-mentioned compact cyclotron can be applied to preparation of isotopes such as $^{18}F$, $^{13}N$ or $^{11}C$ besides $^{15}O$. For example, it can be used for preparing F-tagged deoxyglucose (FDG).

The embodiment of a cyclotron is explained above, but other types of particle beam accelerator reduced in size and weight can be produced by using the above-mentioned materials for preventing the generation of radioactive rays.

The invention claimed is:

1. A particle beam accelerator comprising:

a vacuum chamber;

a magnet which generates a constant magnetic field in the vacuum chamber;

acceleration electrodes which generates an electric field in a direction perpendicular to the direction of the magnetic field generated by the magnet in the vacuum chamber; and an extraction electrode which extracts charged particles accelerated in the vacuum chamber;

wherein a deuteron beam having an energy equal to or smaller than 3.5 MeV is generated;

wherein at least a part of surfaces exposed to the charged particles of the vacuum chamber, the acceleration electrodes, and/or the extraction electrode is made of a material including an element having atomic number larger than copper.

2. The particle beam accelerator according to claim 1, wherein the particle beam accelerator is a cyclotron, and the at least a part of the surfaces exposed to the charged particles comprises surfaces, arranged along the circular orbit, of the charged particles of structural components including said vacuum chamber, said acceleration electrodes, and said extraction electrode.

3. The particle beam accelerator according to claim 1, wherein the at least a part of the surfaces exposed to the charged particles comprises a plating layer including the material.

4. The particle beam accelerator according to claim 1, wherein the at least a part of the surfaces exposed to the charged particles comprises a coating film including the material.

5. The particle beam accelerator according to claim 1, wherein the at least a part of the surfaces exposed to the charged particles is the acceleration electrodes and the element is gold.

6. The particle beam accelerator according to claim 1, further comprising a structural element made of the material arranged at a position in an area not including the electrodes for the resonator or in the valley of the poles of the electromagnet to block a part of the beam.

7. The particle beam accelerator according to claim 1, further comprising a heater provided at one of the components arranged in said vacuum chamber for heating the one of the components.

8. The particle beam accelerator according to claim 1, further comprising an instrument, provided in said vacuum chamber, for measuring a current of the accelerated beam, wherein the at least a part of the surfaces exposed to the charged particles comprises a surface of the instrument facing the beam.

9. The particle beam accelerator according to claim 1, wherein the at least a part of the surfaces exposed to the charged particles of the vacuum chamber, the acceleration electrodes, and/or the extraction electrode is covered by a sheet of the material.

10. The particle beam accelerator according to claim 9, wherein the sheet of the material is thick enough to stop the accelerated deuteron therein.

11. The particle beam accelerator according to claim 1, wherein said material has a dose equivalent of neutrons for a deuteron beam of energy of 3.5 MeV equal to or smaller than $2.5*10^{-1}$ Sv/h/μA/sr.

12. The particle beam accelerator according to claim 11, wherein the dose equivalent of neutrons for said material, when a deuteron beam of energy of 3.5 MeV strikes the material, is equal to or smaller than $2.5*10^{-2}$ Sv/h/μA/sr.

13. The particle beam accelerator according to claim 1, further comprising a target cell provided at a position at which the charged particles extracted by the extraction electrode strike.

14. The particle beam accelerator according to claim 13, wherein the target cell is separated from the other components in the particle beam accelerator, and a shielding wall for shielding radioactive rays generated in the target cell is provided around the target cell.

15. The particle beam accelerator according to claim 13, further comprising a synthesis apparatus which receives a substance generated in the target cell as a starting material, the synthesis apparatus being integrated as a unit with the target cell.

* * * * *

UNITED STATES PATENT AND TRADEMARK OFFICE

CERTIFICATE OF CORRECTION

PATENT NO. : 7,888,891 B2
APPLICATION NO. : 10/594680
DATED : February 15, 2011
INVENTOR(S) : Hidehiro Iida et al.

It is certified that error appears in the above-identified patent and that said Letters Patent is hereby corrected as shown below:

ON THE TITLE PAGE:

At item (75), Inventors, "Mamoru Fujimara, Suita (JP)" should be --Mamoru Fujiwara, Suita (JP)--.

At item (73), Assignee, change:

"(73) Assignee: National Cerebral and Cardiovascular Center, Osaka (JP)"

to

--(73) Assignees: National Cerebral and Cardiovascular Center, Osaka (JP); Molecular Imaging Laboratory, Inc., Kobe-shi (JP)--.

In claim 1, at column 9, line 6, change "acceleration electrodes which generates" to --acceleration electrodes which generate--.

Signed and Sealed this
Sixth Day of September, 2011

David J. Kappos

David J. Kappos
*Director of the United States Patent and Trademark Office*